US006557782B1

(12) United States Patent
Urra

(10) Patent No.: US 6,557,782 B1
(45) Date of Patent: May 6, 2003

(54) PERFUMED SHOWER HEAD

(76) Inventor: Eleodoro Urra, 103 Thayer St. Apt 22-C, New York City, NY (US) 10040

( * ) Notice: Subject to any disclaimer, the term of this patent is extended or adjusted under 35 U.S.C. 154(b) by 0 days.

(21) Appl. No.: 09/876,961

(22) Filed: Jun. 8, 2001

(51) Int. Cl.[7] ..... B05B 7/26
(52) U.S. Cl. ..... 239/315; 239/310; 239/302
(58) Field of Search ..... 239/302, 310, 239/315

(56) References Cited

U.S. PATENT DOCUMENTS

| | | | | | |
|---|---|---|---|---|---|
| 1,154,349 | A | * | 9/1915 | Tanaka | 239/315 |
| 1,751,524 | A | * | 3/1930 | Moss | 239/315 |
| 1,806,025 | A | * | 5/1931 | Seaman | 239/315 |
| 2,156,114 | A | * | 4/1939 | Gilford | 239/315 |
| 2,690,930 | A | * | 10/1954 | Corson | 239/310 |
| 2,878,066 | A | | 3/1959 | Erwin | |
| 2,975,980 | A | * | 3/1961 | Siebert et al. | 239/310 |
| 2,986,340 | A | | 5/1961 | Webb | |
| 3,008,650 | A | * | 11/1961 | Prokop, Sr. | 239/310 |
| 3,759,284 | A | * | 9/1973 | Crowley et al. | 239/315 |
| 3,788,553 | A | * | 1/1974 | Heckman | 239/315 |
| 3,801,018 | A | | 4/1974 | Plotz | |
| D251,679 | S | | 4/1979 | Kwan | |
| 5,957,387 | A | | 9/1999 | Porta et al. | |
| 6,006,374 | A | | 12/1999 | Winnett et al. | |

* cited by examiner

*Primary Examiner*—Michael Mar
*Assistant Examiner*—Christopher Kim

(57) ABSTRACT

A perfumed shower head includes a body conduit that has a perimeter wall for defining a lumen. The coupler member is for coupling to a water supply line. A cap member is removably couplable to the body conduit. The cap member has a plurality of apertures that extend through the cap member. The apertures are for dividing water passing through the lumen of the body conduit into a plurality of streams to bathe a user. A scenting member is removably positionable within the lumen of the body conduit. The scenting member includes a porous material. The porous material includes a scenting agent such that the scenting agent is for transferring to the water and onto the bathing user when water flows through the scenting member.

2 Claims, 2 Drawing Sheets

PERFUMED SHOWER HEAD

BACKGROUND OF THE INVENTION

1. Field of the Invention

The present invention relates to showerheads and more particularly pertains to a new perfumed shower head for mixing a fragrance or moisturizer with the water as it passes through the showerhead.

2. Description of the Prior Art

The use of showerheads is known in the prior art. More specifically, showerheads heretofore devised and utilized are known to consist basically of familiar, expected and obvious structural configurations, notwithstanding the myriad of designs encompassed by the crowded prior art, which have been developed for the fulfillment of countless objectives and requirements.

Known prior art includes U.S. Pat. No. 2,986,340; U.S. Pat. No. 5,957,387; U.S. Pat. No. 6,006,374; U.S. Pat. No. Des. 251,679; U.S. Pat. No. 3,801,018; and U.S. Pat. No. 2,878,066.

While these devices fulfill their respective, particular objectives and requirements, the aforementioned patents do not disclose a new perfumed shower head. The inventive device includes a body conduit that has a perimeter wall for defining a lumen. The body conduit has a coupler member positioned at an end of the body conduit. The coupler member is adapted for coupling to a water supply line such that water passes into the lumen of the body conduit when the coupler member is coupled to the water supply line. A cab member is removably couplable to the body conduit. The cap member has a plurality of apertures that extend through the cap member. The apertures are adapted for dividing water passing through the lumen of the body conduit into a plurality of streams to bathe a user. A scenting member is removably positionable within the lumen of the body conduit. The scenting member includes a porous material such that the scenting member is adapted for permitting water to flow through the scenting member. The porous material includes a scenting agent such that the scenting agent is adapted for transferring to the water and onto the bathing user when water flows through the scenting member.

In these respects, the perfumed shower head according to the present invention substantially departs from the conventional concepts and designs of the prior art, and in so doing provides an apparatus primarily developed for the purpose of mixing a fragrance or moisturizer with the water as it passes through the showerhead.

SUMMARY OF THE INVENTION

In view of the foregoing disadvantages inherent in the known types of shower heads now present in the prior art, the present invention provides a new perfumed shower head construction wherein the same can be utilized for mixing a fragrance or moisturizer with the water as it passes through the shower head.

The general purpose of the present invention, which will be described subsequently in greater detail, is to provide a new perfumed shower head apparatus and method which has many of the advantages of the shower heads mentioned heretofore and many novel features that result in a new perfumed shower head which is not anticipated, rendered obvious, suggested, or even implied by any of the prior art shower heads, either alone or in any combination thereof.

To attain this, the present invention generally includes a body conduit that has a perimeter wall for defining a lumen. The body conduit has a coupler member positioned at an end of the body conduit. The coupler member is adapted for coupling to a water supply line such that water passes into the lumen of the body conduit when the coupler member is coupled to the water supply line. A cab member is removably couplable to the body conduit. The cap member has a plurality of apertures that extend through the cap member. The apertures are adapted for dividing water passing through the lumen of the body conduit into a plurality of streams to bathe a user. A scenting member is removably positionable within the lumen of the body conduit. The scenting member includes a porous material such that the scenting member is adapted for permitting water to flow through the scenting member. The porous material includes a scenting agent such that the scenting agent is adapted for transferring to the water and onto the bathing user when water flows through the scenting member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new perfumed shower head apparatus and method which has many of the advantages of the shower heads mentioned heretofore and many novel features that result in a new perfumed shower head which is not anticipated, rendered obvious, suggested, or even implied by any of the prior art shower heads, either alone or in any combination thereof.

It is another object of the present invention to provide a new perfumed shower head, which may be easily and efficiently manufactured and marketed.

It is a further object of the present invention to provide a new perfumed shower head, which is of a durable and reliable construction.

An even further object of the present invention is to provide a new perfumed shower head which is susceptible of a low cost of manufacture with regard to both materials and labor, and which accordingly is then susceptible of low prices of sale to the consuming public, thereby making such perfumed shower head economically available to the buying public.

Still yet another object of the present invention is to provide a new perfumed shower head, which provides in the apparatuses and methods of the prior art some of the advantages thereof, while simultaneously overcoming some of the disadvantages normally associated therewith.

Still another object of the present invention is to provide a new perfumed shower head for mixing a fragrance or moisturizer with the water as it passes through the showerhead.

Yet another object of the present invention is to provide a new perfumed shower head, which includes a body conduit that has a perimeter wall for defining a lumen. The body conduit has a coupler member positioned at an end of the body conduit. The coupler member is adapted for coupling to a water supply line such that water passes into the lumen of the body conduit when the coupler member is coupled to the water supply line. A cab member is removably couplable to the body conduit. The cap member has a plurality of apertures that extend through the cap member. The apertures are adapted for dividing water passing through the lumen of the body conduit into a plurality of streams to bathe a user. A scenting member is removably positionable within the lumen of the body conduit. The scenting member includes a porous material such that the scenting member is adapted for permitting water to flow through the scenting member. The porous material includes a scenting agent such that the scenting agent is adapted for transferring to the water and onto the bathing user when water flows through the scenting member.

Still yet another object of the present invention is to provide a new perfumed shower head that would eliminate the use of traditional air fresheners and sprays, which would save consumers money. The present invention would also remove bacteria, germs, and other impurities in the water for a cleaner and healthier shower.

Even still another object of the present invention is to provide a new perfumed shower head that would create an atmosphere of relaxation. As a variation, aloe vera, or other items used to treat skin conditions could be used to soften and improve skin conditions.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
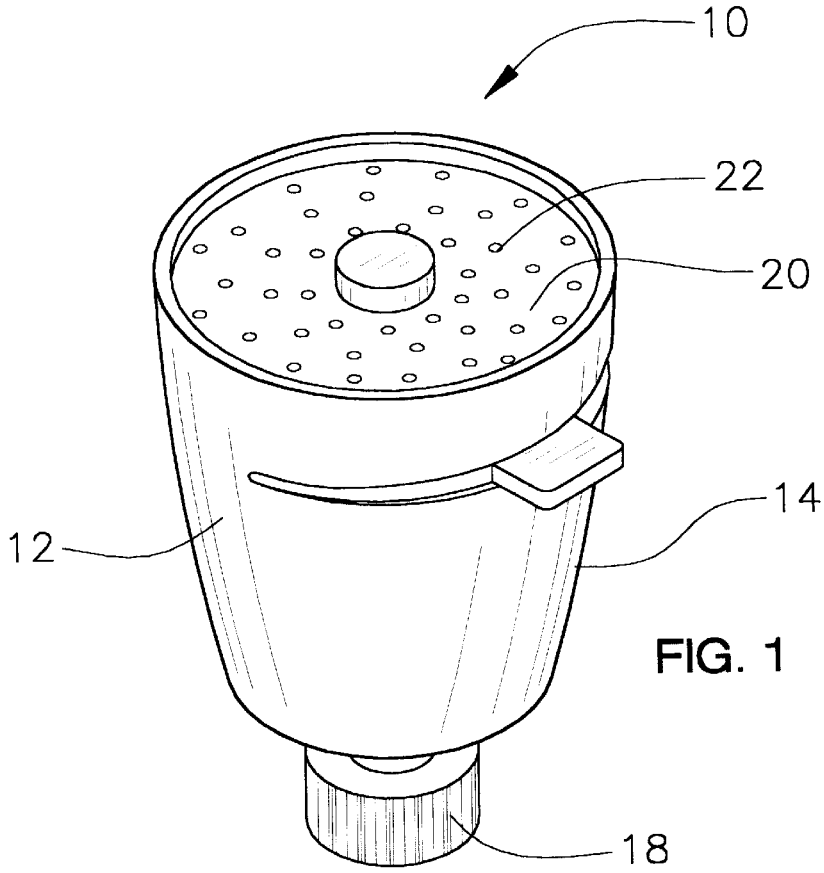
FIG. 1 is a perspective view of a new perfumed shower head according to the present invention.
Figure 2:
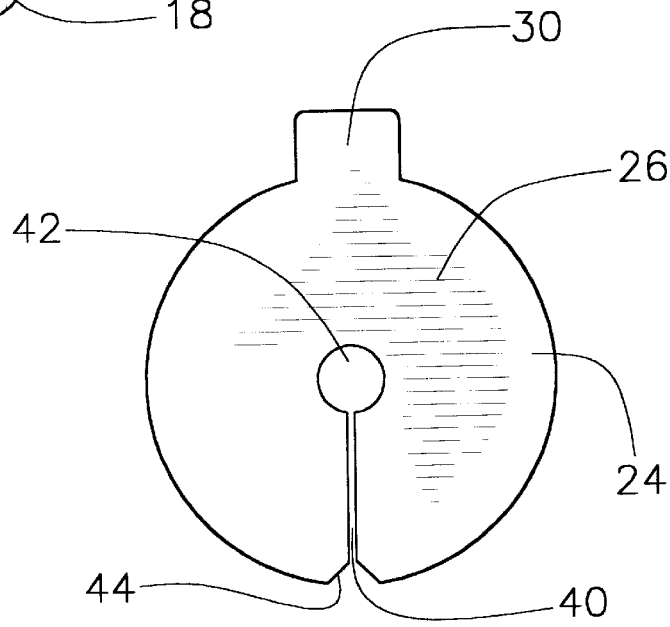
FIG. 2 is a top view of the present invention.
Figure 3:
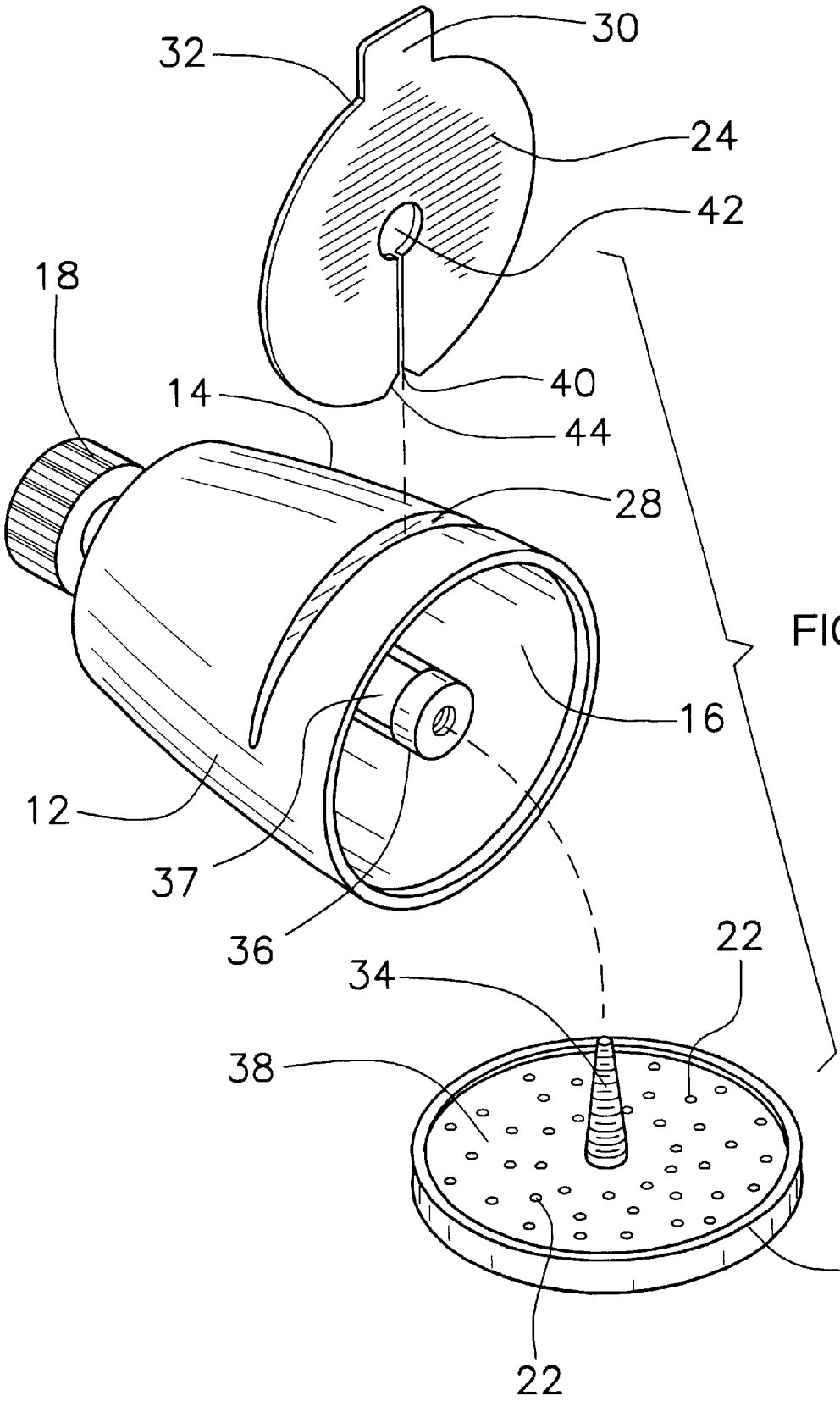
FIG. 3 is a perspective view of the present invention.

With reference now to the drawings, and in particular to FIGS. 1 through 3 thereof, a new perfumed shower head embodying the principles and concepts of the present invention and generally designated by the reference numeral 10 will be described.

As best illustrated in FIGS. 1 through 3, the perfumed shower head 10 generally includes a body conduit 12 that has a perimeter wall 14 for defining a lumen 16. The body conduit 12 has a coupler member 18 positioned at an end of the body conduit 12. The coupler member 18 is adapted for coupling to a water supply line such that water passes into the lumen 16 of the body conduit 12 when the coupler member 18 is coupled to the water supply line. A cap member 20 is removably couplable to the body conduit 12. The cap member 20 has a plurality of apertures 22 that extend through the cap member 20. The apertures 22 are adapted for dividing water passing through the lumen 16 of the body conduit 12 into a plurality of streams to bathe a user. A scenting member 24 is removably positionable within the lumen 16 of the body conduit 12. The scenting member 24 includes a porous material 26 such that the scenting member 24 is adapted for permitting water to flow through the scenting member 24. The porous material 26 includes a scenting agent such that the scenting agent is adapted for transferring to the water and onto the bathing user when water flows through the scenting member 24.

The body conduit 12 has a slot 28 that extends through the perimeter wall 14 of the body conduit 12. The scenting member 24 is selectively insertable into the lumen 16 of the body conduit 12 through the slot 28 in the body conduit 12.

The scenting member 24 has a tab 30 that outwardly extends from a peripheral edge 32 of the scenting member 24. The tab 30 is for extending from the body conduit 12 when the scenting member 24 is inserted into the body conduit 12. The tab 30 is for facilitating removal of the scenting member 24 for the body conduit 12.

The cap member 20 has a connecting portion 34. The connecting portion 34 is removably coupled to a mounting portion 36 of the body conduit 12 such that the connecting portion 34 of the cap member 20 is for securing the cap member 20 to the mounting portion 36 of the body conduit 12.

The connecting portion 34 is centrally positioned on a back face 38 of the cap member 20. The mounting portion 36 is coupled to the perimeter wall 14 of the body conduit 12 such that the mounting portion 36 is centrally positioned within the lumen 16 of the body conduit 12. A plurality of methods can be employed for connecting the mounting portion 36 to the perimeter wall of the body conduit 12, one of such methods is shown in FIG. 3 showing a support member 37 extending from the mounting portion 36 to the perimeter wall 12. The connecting portion 34 of the cap member 20 is alignable with the mounting portion 36 of the body conduit 12 for aligning the cap member 20 with the body conduit 12 for preventing water from leaking out between the body conduit 12 and the cap member 20 when the cap member 20 is coupled to the body conduit 12.

The scenting member 24 has a slit 40 that extends between a peripheral edge 32 of the scenting member 24 and a central bore 42 of the scenting member 24. The slot 28 is for allowing the scenting member 24 to flex around the mounting portion 36 of the body conduit 12 when the scenting member 24 is inserted into the body conduit 12. The central bore 42 is for receiving the mounting portion 36 of the body conduit 12 when the scenting member 24 is inserted into the body conduit 12.

The slit 40 of the scenting member 24 has a splayed end 44. The splayed end 44 positioned opposite the central bore 42 of the scenting member 24. The splayed end 44 is for directing the slit 40 of the scenting member 24 into alignment with the mounting portion 36 of the body conduit 12 when the scenting member 24 is inserted into the body conduit 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. The perfume dispersing showerhead for dispersing perfumed water over a user taking a shower, the perfume dispersing shower head comprising:

a body conduit having a perimeter wall defining a lumen, said body conduit having a coupler member positioned at an end of said body conduit, said coupler member being adapted for coupling to a water supply line such that water passes into said lumen of said body conduit when said coupler member is coupled to the water supply line;

a cap member being removably couplable to said body conduit, said cap member having a plurality of apertures extending through said cap member, said apertures being adapted for dividing water passing through said lumen of said body conduit into a plurality of streams to bathe a user;

a scenting member being removably positionable within said lumen of said body conduit, said scenting member comprising a porous material such that said scenting member is adapted for permitting water to flow through said scenting member when water passes through said lumen of said body conduit, said porous material comprising a scenting agent such that said scenting agent is adapted for transferring to the water and onto the bathing user when water flows through said scenting member; and said cap member having a connecting portion, said connecting portion being removably coupled to a mounting portion of said body conduit such that said connecting portion of said cap member is for securing said cap member to said mounting portion of said body conduit;

said scenting member having a slit extending between a peripheral edge of said scenting member and a central bore of said scenting member, said slot being for allowing said scenting member to flex around said mounting portion of said body conduit when said scenting member is inserted into said body conduit, said central bore being for receiving said mounting portion of said body conduit when said scenting member is inserted into said body conduit.

2. The perfume dispersing showerhead as set forth in claim 1, further comprising;

said slit of said scenting member having a splayed end, said splayed end positioned opposite said central bore of said scenting member, said splayed end being for directing said slit of said scenting member into alignment with said mounting portion of said body conduit when said scenting member is inserted into said body conduit.

* * * * *